United States Patent [19]

Johanson et al.

[11] Patent Number: 4,756,418

[45] Date of Patent: Jul. 12, 1988

[54] ANTI-CLOCKSPRINGING APPARATUS AND METHOD

[75] Inventors: Robert H. Johanson; Lawrence P. Kenney, both of Rochester, N.Y.

[73] Assignee: Eastman Kodak Company, Rochester, N.Y.

[21] Appl. No.: 894,974

[22] Filed: Aug. 8, 1986

[51] Int. Cl.[4] ..... B65D 81/30; B65D 85/671

[52] U.S. Cl. ..... 206/397; 206/316; 206/408; 242/75.4; 354/275

[58] Field of Search ..... 206/316, 389, 391, 397, 206/403–405, 408, 409, 414, 415; 242/55.53, 71.1, 71.2, 75.4, 99; 354/275

[56] References Cited

U.S. PATENT DOCUMENTS 1,348,857 8/1920 Ford ..... 206/415

4,221,479 9/1980 Harvey ..... 354/275

FOREIGN PATENT DOCUMENTS 0189168 7/1986 European Pat. Off. .

*Primary Examiner*—Jimmy G. Foster

*Attorney, Agent, or Firm*—William C. Dixon

[57] ABSTRACT

An apparatus and method are disclosed for preventing clockspringing of a wound roll of web material within a cartridge during storage and shipment. The roll of web material is mounted on a central core arranged to rotate with the roll of material within the cartridge. The core has a notch that is alignable with a slot in the cartridge. A clip separate from the core and cartridge has one end thereof insertable through the notch and slot for locking the core to the cartridge, thereby preventing clockspringing of the roll of web material.

9 Claims, 3 Drawing Sheets

ANTI-CLOCKSPRINGING APPARATUS AND METHOD

FIELD OF THE INVENTION

The present invention relates generally to a web cartridge, and more specifically to an anti-clockspringing apparatus and method for preventing clockspringing of the wound roll of web material within a cartridge during storage and shipment.

BACKGROUND OF THE INVENTION

In various packages or cartridges now in use for webs of photographic film and paper, the web is wound on a spool or core, with or without flanges, and is disposed within a magazine which totally surrounds the web and protects it from light and other damaging effects. One end of the web is normally secured to the core or spool center and the other end extends out of the magazine through a slot therein. The other end is fastened to the surface of the cartridge and is released therefrom for insertion into a camera or the like. It has been found that there is a tendency for the web in such cartridges to unwind during handling and shipping. Inasmuch as the inner end of the web is connected to the core or the spool center and the outer end is normally secured to the outer surface of the cartridge, the web acts as a released clockspring, turning the spool as it unwinds. Such clockspringing can result in scratching of the surface of adjacent web convolutions causing a deterioration in the quality of the image that may be recorded thereon. In other instances, the web can clockspring outwardly to the extent that the outer convolution of web jams against the inner surface of the cartridge making subsequent unreeling of the web difficult or impossible. In those situations in which the outer end of the web is not fastened to the surface of the cartridge or is inadvertently released from the cartridge surface, the clockspringing can cause the outer end of the web to be pulled back through the slot into the cartridge resulting in a cartridge that is completely unusable.

Various attempts have been made in providing anti-clockspringing apparatus to prevent unwinding of the web in cartridges. For example, a core-locking device for a web dispensing cassette is disclosed and published as item No. 16352 in the November 1977 issue of *Research Disclosure.* In this core-locking apparatus, a web winding core is provided with a slotted end, and a core-locking member is provided that is captive and slideable (but yet light-tight) in one of two end caps of the cassette. In U.S. Pat. No. 3,784,001 which issued to Bushnell et al. on Jan. 8, 1974, a film cartridge is disclosed in which clockspringing of a roll of film is prevented by providing a flangeable connector between the core and a portion of the cartridge which has sufficient strength to prevent the core from rotating during shipping but which will break as the film is withdrawn from the cartridge, permitting the core to rotate. In U.S. Pat. No. 4,210,296, which issued to Frechette on July 1, 1980, a ribbon cartridge with an integral anti-spool rotation device is disclosed. The anti-spool rotation device comprises an axially movable core insert connected to the cartridge wall by flexible bridges or arms. The core insert is manually pressed into the open end of the core to frictionally hold the core against rotation. Upon mounting the cartridge in a machine, a post thereon will axially push the core insert out of frictional engagement with the spool core thereby allowing free rotation of the supply spool. In still another prior art reference, U.S. Pat. No. 3,613,876, which issued to Kohler et al. on Oct. 19, 1971, an anti-clockspring device is disclosed for a film cartridge in which one or more spot welds is provided between the surface of the core and the end of the hub. The spot weld has sufficient strength to prevent the core from rotating during shipping, but will break as the film is withdrawn from the cartridge, permitting the core to rotate. It is also known in the prior art to prevent clockspringing of a wound roll of web material within a cartridge by providing aligned notches in outer surfaces of the core end and cartridge wall and placing a rubber band around the entire cartridge with the band nesting in the notches. Although the various prior art attempts at solving the anti-clockspringing problem in web cartridges have had various degrees of success, the need still exists for a simple, reliable and economical anti-clockspringing apparatus and method.

Therefor an object of the present invention is to provide an anti-clockspringing apparatus and method that is of simple design and construction, thoroughly efficient and reliable in operation, and economical to manufacture.

SUMMARY OF THE INVENTION

An object of this invention is accomplished by providing an apparatus for preventing clockspringing of a wound roll of web material within a cartridge during storage and shipment in which the roll of web material is mounted on a central core arranged to rotate on its axis within the cartridge, the mechanism comprising:

- a notch on the core;
- a slot in the cartridge alignable with the notch; and
- a clip separate from the core and cartridge having an end portion thereof insertable through the aligned notch and slot for locking the core to the cartridge, thereby preventing clockspringing of the roll of web material.

A further object of the present invention is accomplished by a method of preventing clockspringing of a wound roll of web material within a cartridge during storage and shipment. The roll of web material is mounted on a central core arranged to rotate on its axis within the cartridge, the cartridge having a slot and the core having a notch alignable therewith. The method of preventing clockspringing comprises the steps of:

- aligning the notch and the slot; and
- inserting an end portion of a clip through the notch and the slot for locking the core to the cartridge.

BRIEF DESCRIPTION OF THE DRAWINGS

In the detailed description of the invention presented below, reference is made to the accompanying drawings, in which.

DETAILED DESCRIPTION OF THE INVENTION

Figure 1:
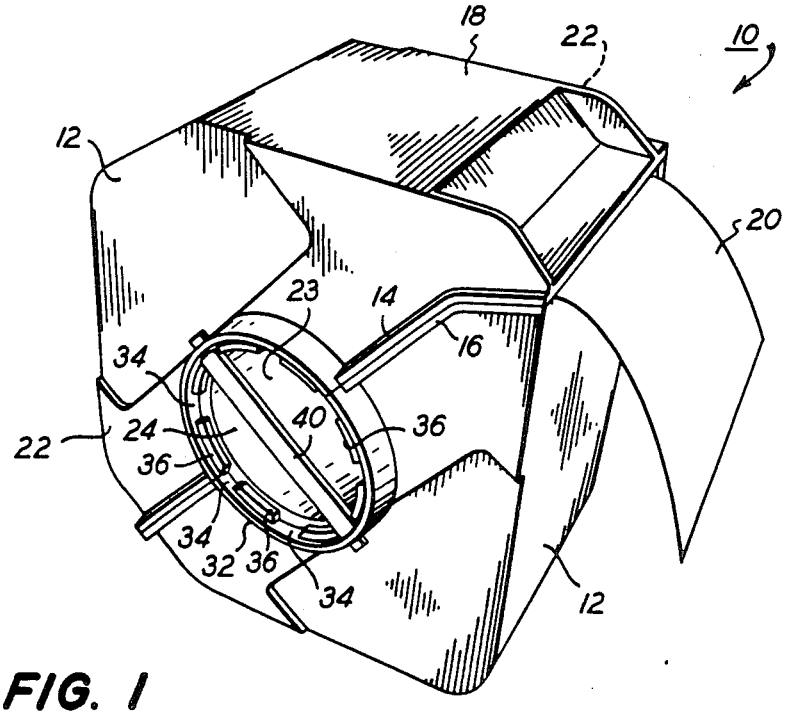
FIG. 1 is a perspective view of a cartridge in which a preferred embodiment of an apparatus for preventing clockspringing of a wound roll of web material is incorporated.
Figure 2:
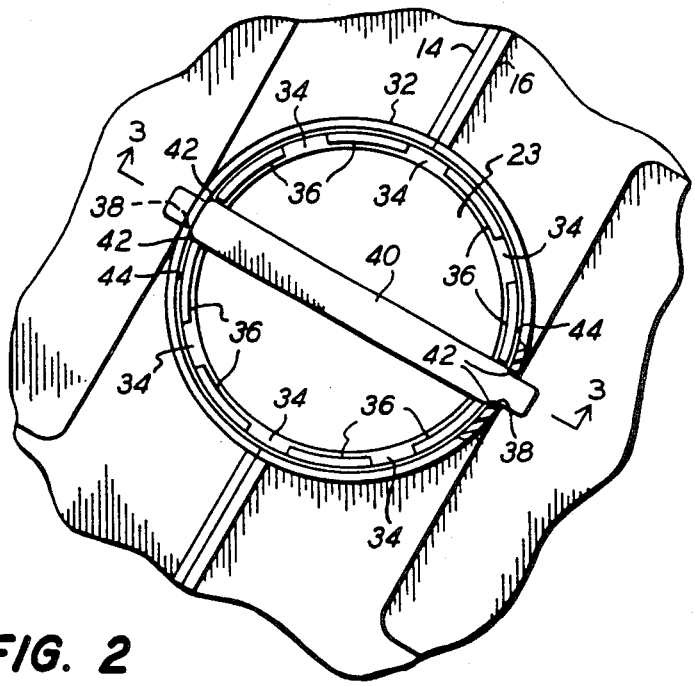
FIG. 2 is an enlarged segmental end view of the central portion of the cartridge of FIG. 1 with a portion thereof broken away and sectioned.
Figure 3:
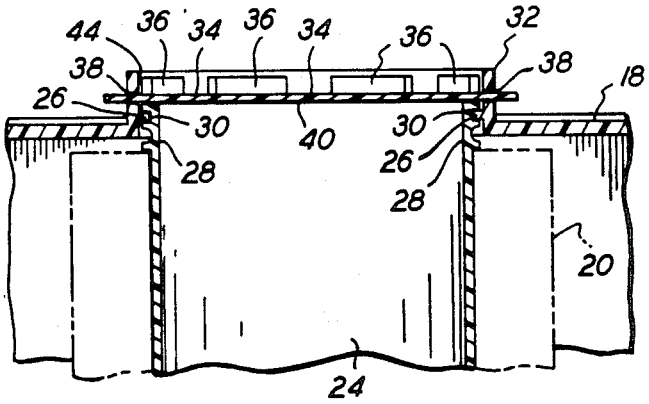
FIG. 3 is a segmental section view taken substantially along line 3—3 of FIG. 2.

With reference to FIGS. 1-3, a preferred embodiment of the apparatus for preventing clockspringing of a wound roll of web material is disclosed in a cartridge. The cartridge 10 comprises a pair of V-shaped cup members 12 joined together along rims 14, 16 thereof to form a substantially square housing 18 for a wound roll of web material 20. Since the opposite side walls 22 of the housing are substantially identical, only one side wall 22 will be disclosed and described in detail hereinafter.

The housing side wall 22 defines a circular opening 23 for receiving an end of a cylindrical core 24. The housing side wall 22 further defines, as best seen in FIG. 3, a rib 26 on the inner periphery of the opening for rotatably supporting core end 28. The core end 28 has a peripheral groove 30 for receiving rib 26 to form a bearing for rotatably supporting core 24. The housing side wall 22 further defines an axially extending ring 32 into which the core end 28 extends.

The apparatus for preventing clockspringing of a wound roll of web material 20 within cartridge 10 comprises providing an end surface of core 24 with a plurality of spaced notches 34 and ribs 36. The ring 32 is provided with diametrically opposed slots 38 extending therethrough in radial alignment with notches 34. A clip 40, preferably comprising a flexible strip of any suitable plastic material, such as polycarbonate is used to positively lock core 24 to ring 32 by angularly aligning a notch 34 and slot 38, inserting one end of strip 40 through the aligned notch and slot, flexing the strip to shorten it and then inserting the opposite end thereof as the strip unflexes through the diametrically opposed angularly aligned notch 34 and slot 38. In this locked position of clip 40, see FIG. 2, shoulders 42 on the end portions of the clip engage the inner surface 44 of ring 32 to prevent lengthwise movement of the clip out of the notches and slots for inadvertently unlocking core 24 from ring 32.

Figure 4:
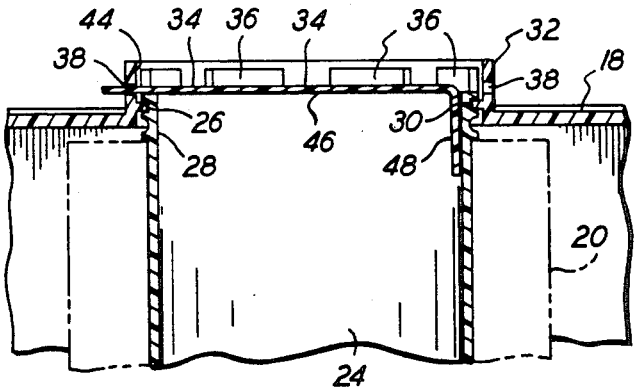
FIG. 4 is a section view similar to FIG. 3 showing another embodiment of the locking clip.

With reference to FIG. 4, another embodiment of the locking clip 40 is disclosed comprising a reverse L-shaped strip 46 in which one end thereof is insertable through a radially aligned notch 34 and slot 38, and the opposite flexed end 48 thereof is inserted into core 24 in frictional engagement with the inner periphery of the core.

Figure 4A:
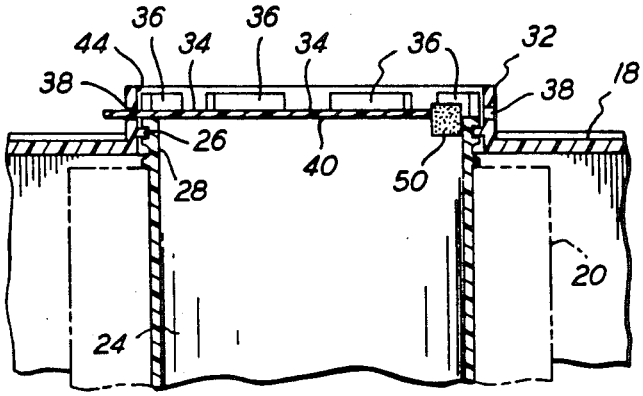
FIG. 4A is a section view similar to FIG. 4 showing still another embodiment of the locking clip.

With reference to FIG. 4A, still another embodiment of the locking clip 40 is shown in which one end is insertable in a radially aligned notch 34 and slot 38, and the opposite end thereof is provided with a resilient member 50 formed of a foam material or the like for frictionally engaging the inner periphery of the core.

Figure 5:
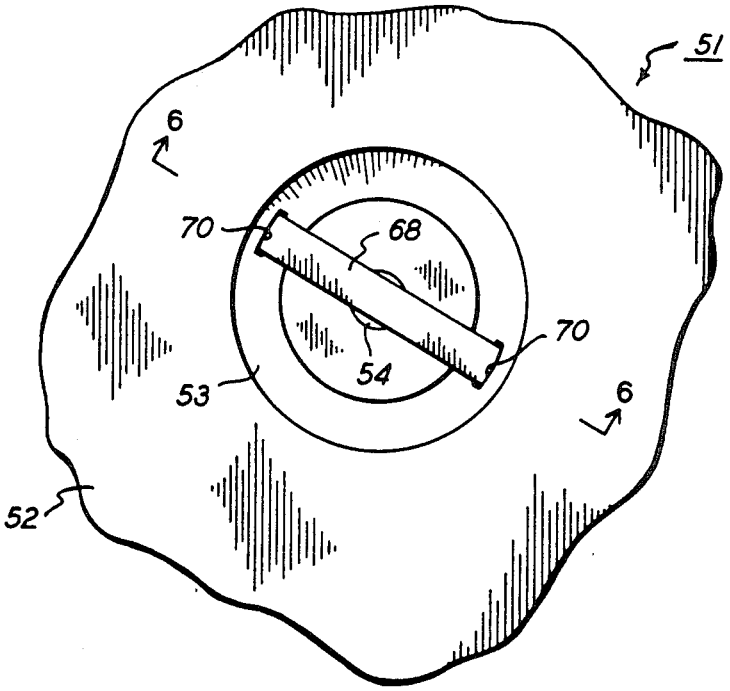
FIG. 5 is a segmental end view similar to FIG. 2 of another embodiment of an apparatus for preventing clockspringing of a wound roll of web material in a cartridge.
Figure 6:
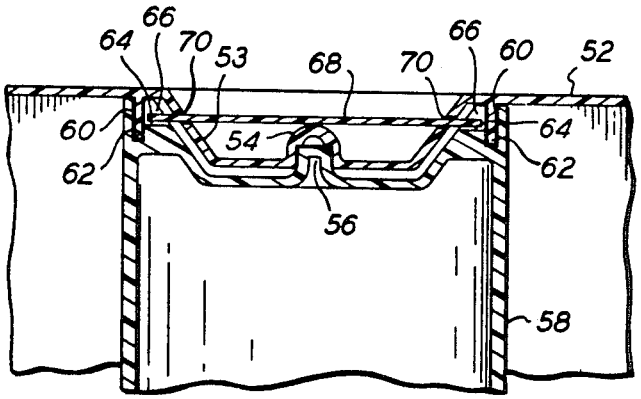
FIG. 6 is a section view taken substantially along line 6—6 of FIG. 5.

FIGS. 5 and 6 illustrate a different cartridge construction in which the locking clip of this invention is embodied. In this cartridge 51, each of the opposite walls 52 is substantially continuous with at least one of the walls having a central cup-shaped recessed portion 53 having an axially extending cylindrical cup member 54 for rotatably supporting a stub shaft 56 at one end of a core 58. The core end has an annular groove 60 for receiving a ring 62 on cartridge wall 52 to form a light lock. The core 58 further has an annular end surface provided with a plurality of spaced notches 64 and ribs 66, as best seen in FIG. 6. Locking of the core 58 to the cartridge 51 is achieved by inserting one end of a flexible clip 68 through a radially extending slot 70 in recessed portion 53 of cartridge wall 52 and into a radially and angularly aligned notch 64 in core 58, flexing the clip to shorten it, and inserting the opposite end thereof as the clip unflexes through a diametrically opposed slot 70 in the cartridge wall and into a radially and angularly aligned notch 64. The ring 62 forms a stop for the ends of clip 68 to prevent inadvertent removal of the clip from its locking position.

While preferred embodiments of the invention have been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

I claim:

1. An apparatus for preventing clockspringing of a wound roll of web material within a cartridge during storage and shipment in which said roll of web material is mounted on a central core arranged to rotate on its axis within said cartridge, the apparatus comprising:
   - a slot in said cartridge;
   - a notch on said core adapted to be aligned with said slot upon manual rotation of said core; and
   - a clip normally disconnected from said core and said cartridge, said clip having an end portion thereof manually insertable through said aligned notch and slot for locking said core to said cartridge, thereby preventing clockspringing of said roll of web material.

2. The apparatus according to claim 1 wherein said clip comprises a flexible strip of plastic or the like.

3. The apparatus according to claim 1 wherein said cartridge has an axially extending ring, and said slot extends radially through said ring, and an end of said core is rotatable within said ring with said notch located in the end surface of said core in radial alignment with said slot.

4. An apparatus for preventing clockspringing of a wound roll of web material within a cartridge during storage and shipment in which said roll of web material is mounted on a central core arranged to rotate on its axis within said cartridge, the apparatus comprising:
   - an axially extending ring on said cartridge within which an end of said core is rotatable;
   - a pair of diametrically opposed slots in said cartridge extending radially through said ring;
   - a pair of diametrically opposed notches in the end surface of said core adapted to be radially aligned with said slots upon rotation of said core; and
   - a clip comprising a flexible strip normally disconnected from said core and said cartridge, said strip having one end manually insertable through one pair of complementary angularly aligned notches and slots, and the opposite end of said strip manually insertable through a diametrically opposed pair of complementary angularly aligned notches and slots for locking said core to said cartridge, thereby preventing clockspringing of said roll of web material.

5. The apparatus according to claim 4 wherein said flexible strip has a shoulder at each end engageable with one of said core and ring to prevent said ends of said strip from sliding through said notches and slots, thereby inadvertently unlocking said core from said cartridge.

6. An apparatus for preventing clockspringing of a wound roll of web material within a cartridge during storage and shipment in which said roll of web material is mounted on a central core arranged to rotate on its axis within said cartridge, the apparatus comprising:

a cup-shaped recessed wall portion on said cartridge defining a pair of diametrically opposed slots extending through said wall portion, a pair of diametrically opposed notches on the end surface of said core adapted to be aligned with said slots upon rotation of the core; and a clip comprising a flexible strip having one end insertable through one pair of complementary angularly aligned notches and slots, and the opposite end of said strip insertable through a diametrically opposed pair of complementary angularly aligned notches and slots.

7. A method of preventing clockspringing of a wound roll of web material within a cartridge during storage and shipment in which the roll of web material is mounted on a central core arranged to rotate on its axis within the cartridge, the core having a notch and the cartridge having a slot radially alignable therewith, the method comprising the steps of:

rotating the core for angularly aligning said notch and said slot;

flexing a flexible strip to shorten it; and manually inserting an end portion of said flexed strip through said notch and said slot for locking the core to the cartridge when the strip unflexes, thereby preventing clockspringing of the roll of web material.

8. A method of preventing clockspringing of a wound roll of web material within a cartridge during storage and shipment in which the roll of web material is mounted on a central core arranged to rotate on its axis within the cartridge, the core having diametrically opposed notches and the cartridge having diametrically opposed slots radially alignable therewith, the method comprising the steps of:

angularly aligning said notches with said slots; and manually inserting an end portion of a flexible strip through one pair of complementary angularly aligned notches and slots, flexing said strip to shorten it; and then simultaneously unflexing said strip and inserting the opposite end of said strip through the diametrically opposed pair of complementary angularly aligned notches and slots to positively lock the core to the cartridge.

9. A method according to claim 8 in which said flexible strip has a shoulder at each end thereof, said shoulder adapted when said strip returns to its normal unflexed condition to engage one of the core and cartridge to prevent said ends of said strip from sliding out of the notches and slots, thereby inadvertently unlocking the core from the cartridge.

* * * * *